US007561820B2

(12) United States Patent
Gayne et al.

(10) Patent No.: US 7,561,820 B2
(45) Date of Patent: Jul. 14, 2009

(54) SEALS FOR AN IMAGE FORMING APPARATUS

(75) Inventors: Jarrett C. Gayne, Lexington, KY (US); Nicholas Matthew Sullivan, Lancaster, KY (US)

(73) Assignee: Lexmark International, Inc., Lexington, KY (US)

( * ) Notice: Subject to any disclaimer, the term of this patent is extended or adjusted under 35 U.S.C. 154(b) by 284 days.

(21) Appl. No.: 11/234,332

(22) Filed: Sep. 23, 2005

(65) Prior Publication Data

US 2007/0034100 A1 Feb. 15, 2007

Related U.S. Application Data

(63) Continuation-in-part of application No. 11/201,439, filed on Aug. 10, 2005, now abandoned.

(51) Int. Cl.
*G03G 15/08* (2006.01)

(52) U.S. Cl. ..... 399/103; 399/284

(58) Field of Classification Search ..... 399/103, 399/105, 106, 119, 120, 110, 284
See application file for complete search history.

(56) References Cited

U.S. PATENT DOCUMENTS 4,821,672 A 4/1989 Bruno
5,475,467 A 12/1995 Watanabe et al.
5,502,547 A 3/1996 Shirai
5,550,617 A 8/1996 Odagawa et al.
5,671,673 A 9/1997 Boose et al.
5,697,021 A 12/1997 Watanabe et al.
5,875,378 A 2/1999 Campbell et al.
6,021,297 A 2/2000 Campbell et al.
6,070,027 A * 5/2000 Kawai et al. ..... 399/103
6,078,771 A 6/2000 Buchanan et al.
6,195,515 B1 * 2/2001 Fujita et al. ..... 399/103
6,471,773 B1 10/2002 Atkins
6,487,383 B2 11/2002 Buchanan et al.
6,574,444 B2 * 6/2003 Uehara et al. ..... 399/103
6,629,496 B1 10/2003 Boose et al.
6,697,594 B1 2/2004 Murphy et al.
6,832,551 B2 12/2004 Jendroska et al.
6,901,228 B2 * 5/2005 Kamimura et al. ..... 399/103
7,062,195 B2 * 6/2006 Kurihara et al. ..... 399/103 X
2002/0090226 A1 * 7/2002 Sato et al. ..... 399/103
2003/0235438 A1 12/2003 Tatsumi
2004/0131839 A1 * 7/2004 Eagle ..... 428/317.1
2005/0013890 A1 1/2005 Chapman et al.
2005/0158070 A1 * 7/2005 Ishii ..... 399/103

FOREIGN PATENT DOCUMENTS

JP 2001-134081 A * 5/2001

* cited by examiner

*Primary Examiner*—Sophia S Chen
(74) *Attorney, Agent, or Firm*—Steven J. Grossman

(57) ABSTRACT

The present invention relates to seals which may be used in an image forming apparatus. The seals may prevent the leakage of image forming materials, e.g. as between a blade and an image forming apparatus housing.

21 Claims, 7 Drawing Sheets

SEALS FOR AN IMAGE FORMING APPARATUS

CROSS-REFERENCE TO RELATED APPLICATIONS

This application is a continuation-in-part of U.S. application Ser. No. 11/201,439, filed Aug. 10, 2005 now abandoned, entitled "Seals for an Image Forming Apparatus".

FIELD OF THE INVENTION

The present invention relates to seals which may be used in an image forming apparatus. The seals may prevent the leakage of image forming materials, e.g., as between a doctor blade and a component in the image forming device. The image forming apparatus may include an electrophotographic device, ink printer, copier, fax, all-in-one device or multi-functional device

BACKGROUND OF THE INVENTION

An image forming device, such as an electrophotographic device, ink printer, copier, fax, all-in-one device or multi-functional device may use developing agents such as toner or ink, which may be disposed on media to form an image. The developing agent, such as toner, may be fixed to the media using an image fixing apparatus, which may apply heat and/or pressure to the toner. The image fixing apparatus may also include a nip through which the media may be passed. The nip may be formed by a heater opposing a pressure roller. A belt or film may be included in the fixing device, in proximity to the heater to aid the transport of media through the fixing device nip.

SUMMARY OF THE INVENTION

In an exemplary embodiment the present invention relates to a sealing member for an image forming apparatus. The sealing member may utilize non-woven material. The apparatus may include a housing, a roller having a length and a blade extending along the length of the roller. The sealing member may partially overlap an end of the blade and locate between the housing and the blade. The sealing member may be used in a cartridge placed within the image forming apparatus.

DETAILED DESCRIPTION OF THE INVENTION

The present invention relates to seals which may be used in an image forming apparatus. The seals may prevent the leakage of image forming materials, e.g. as between a blade and a housing in the image forming apparatus. The blade may be a "doctor blade" which may control the thickness of image forming material on a given surface, such as a roller surface. The image forming apparatus may include an electrophotographic device, ink printer, copier, fax, all-in-one device or multi-functional device.

Figure 2:
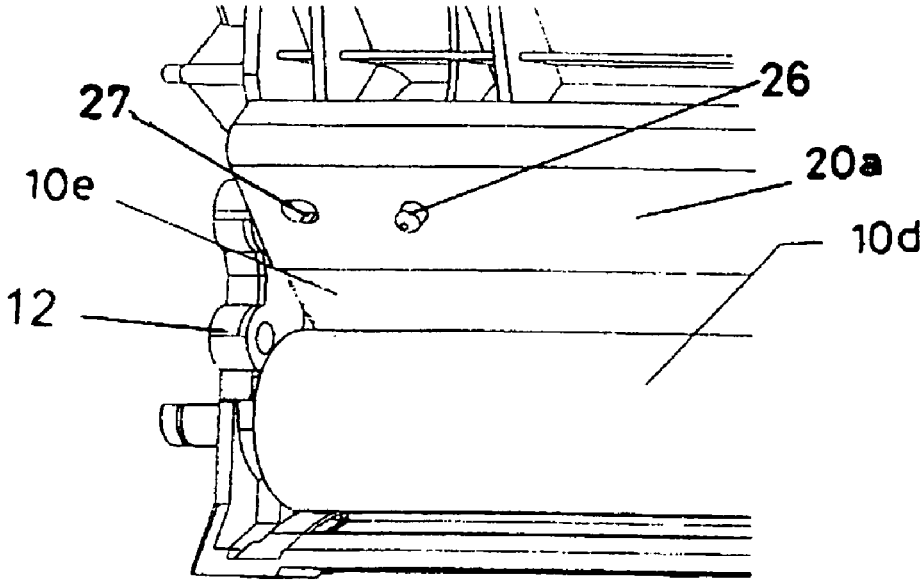
FIG. 2 is a cut away schematic view inside the exemplary housing with the exemplary roller in place below a blade.
Figure 4:
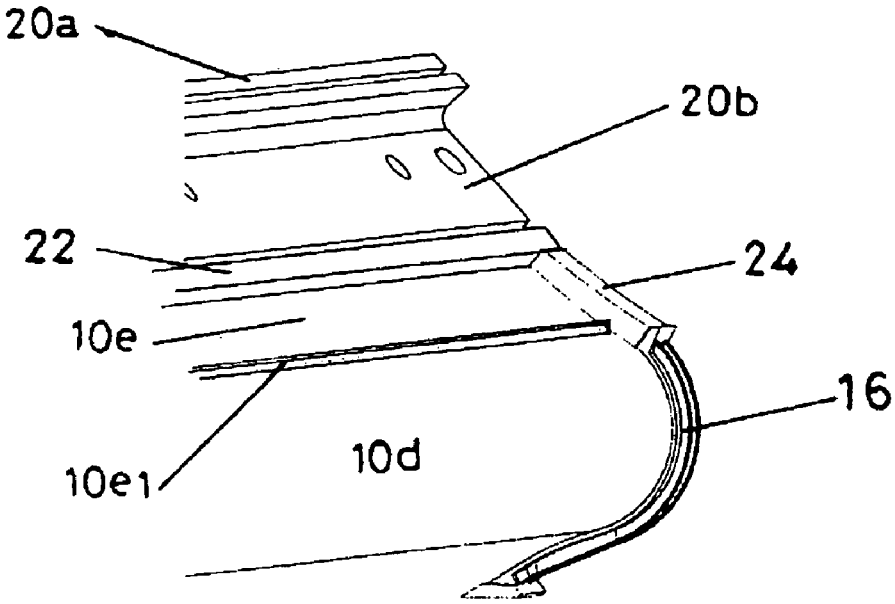
FIG. 4 is a schematic view showing the placement of the exemplary seal of the present invention in relation to the exemplary roller and exemplary blade in an exemplary housing.

With reference first to FIG. 4, an exemplary blade component (10*e*) is illustrated that may therefore be disposed adjacent a roller (10*d*) to regulate the thickness of image forming substance formed therebetween. The exemplary blade (10*e*) (see FIG. 4) may be cantilevered (supported on one side) by a pair blade support members (20*a*), (20*b*) such that the lower surface of the blade (10*e*) may be tangential to the surface of the developer roller (10*d*). FIG. 4 illustrates the blade (10*e*) viewed prior to engagement with a first housing (12). FIG. 2 illustrates the blade (10*e*) assembled with the housing (12). The blade may be relatively flat and may also include a portion that extends beyond the tangent point location with the roller. This may be illustrated with reference to FIG. 6*a* which shows in cross-section blade (10*e*) in tangential engagement with roller (10*d*) and tangent point location (30). As can be see, the blade may include a portion (10*e*1) that extends beyond the illustrated tangent point.

Figure 1:
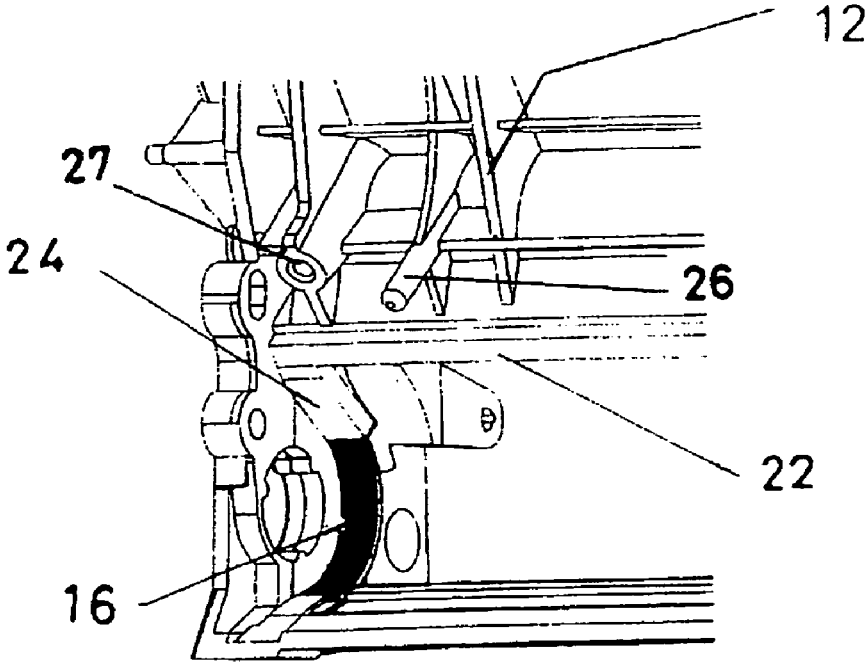
FIG. 1 is a cut away schematic view inside an exemplary housing with the roller removed illustrating an exemplary seal.

The blade support members (20*a*), (20*b*) are further illustrated in FIG. 4. The lower member (20*a*) and upper member (20*b*) may cooperate to clamp the blade (10*e*). The support members may be metal or plastic. The blade (10*e*) may comprise metal or plastic and may therefore be formed from stainless steel. The blade may have a thickness of about 0.005-0.010 inches and all values and increments therebetween. The blade may also include a flange (see 10*e*1 in FIG. 4) along one edge. The flange may be upturned relative to the roller 10*d*. The assembly (members (20*a*), (20*b*), and blade (10*e*) may be located and fastened to the housing (12) using a locator pin (26) and hole (27) (to receive a screw, not shown) as shown in FIG. 1. The assembled condition with roller (10*d*) in place is shown in FIG. 2.

Figure 3:
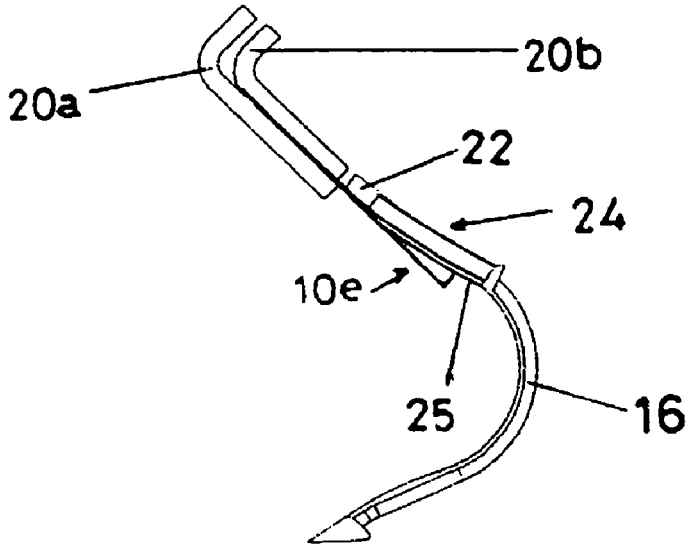
FIG. 3 is a sectional view of an exemplary blade assembly and exemplary seals without the roller present
Figure 7:
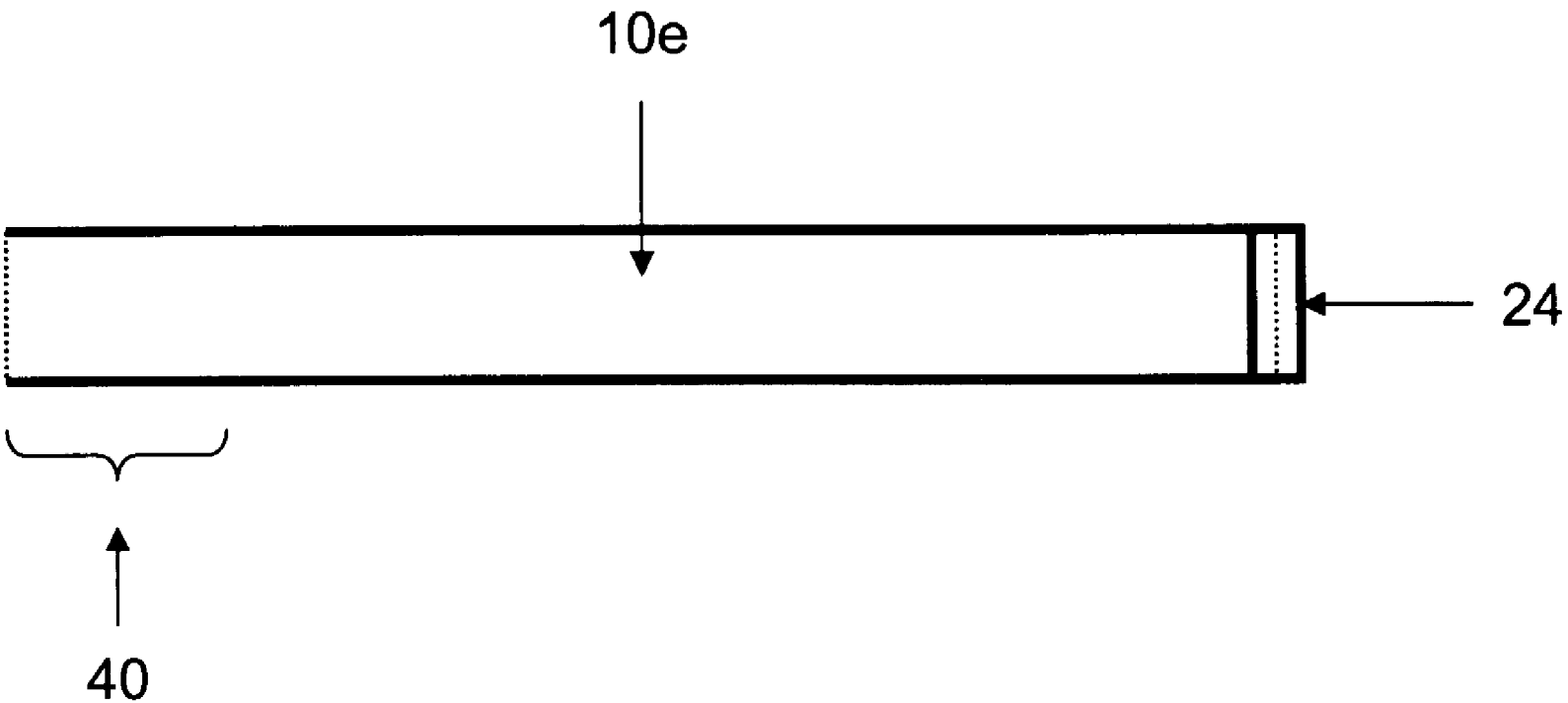
FIG. 7 is a schematic view of a blade and an end seal positioned at one end.

FIG. 3 illustrates the blade (10*e*) extending from the support members (20*a*) and (20*b*) while FIG. 4 illustrates the blade (10*e*) in an assembled condition bearing against the surface of the roller (10*d*) which may deflect the blade (10*e*) upward. That is, the roller (10*d*) may serve to deflect the blade upward against end seal (24) and back seal (22). The end seal (24) may therefore overlap a portion of the end 40 of the blade (10*e*) and may be held in place by the housing (12). With reference to FIG. 7, a general location of the end 40 of the blade 10*e* may be illustrated. On the right hand side of the blade 10*e* the end seal is illustrated in draft and as can be seen, it may overlap a portion of the end 40 of blade 10*e*. The end seal may be formed of any material which may reduce the amount of image forming material from passing as between, e.g., the end seal and housing.

The amount of force which the cantilevered blade (10*e*) may apply to the roller (10*d*) may also be varied and may therefore be adjusted by the relative positions of support members (20*a*) and (20*b*) (see FIG. 3). For example, support member (20*b*) may extend beyond (20*a*) or (20*a*) may extend beyond (20*b*). In such latter exemplary case (support member 20*b* extending beyond support member 20*a*) the relative force on the blade will be increased.

FIG. 1 is a view looking into the housing (12) with the developer roller removed. The end seal (24) may therefore be positioned as shown into the housing and may be engaged with the housing by use of an adhesive. In addition, a curved J-seal (16) may be supplied. Therefore, in FIG. 1, with the roller (10*d*) and blade 10(*e*) removed, one can see the combination of J-seal (16), separate end seal (24) and back seal (22). The curved J-seal (16) (FIG. 2) may therefore be provided to seal the roller (10*d*) to a C-shaped portion of the housing (12). This J-seal may generally comprises a relatively flexible and relatively low modulus material such as urethane, artificial rubber or fluorocarbon polymer having a Shore A hardness of from about 55 to about 75. The back seal (22) (see both FIGS. 1 and 4) may therefore seal along the length of the blade (10*e*) and against the housing (12) (FIG. 1). This may further prevent leakage of image forming material with respect to, e.g., the blade and housing.

It can therefore be appreciated that a gap may exist between the back seal (22) and J-seals (16) when a cantilevered blade (10*e*) tangentially engages the roller (10*d*). As illustrated in FIG. 4 the end seal 24 may fill such gap. As alluded to above, the end seal (24) may also be compressed between the housing (12) (see FIG. 1) and the blade (10*e*) (see FIG. 4) by the roller 10(*d*). The end seals (24) may also abut a rotary seal portion such as a J-seal (16) as well as a back seal (22) as shown in FIGS. 3 and 4.

Figure 6A:
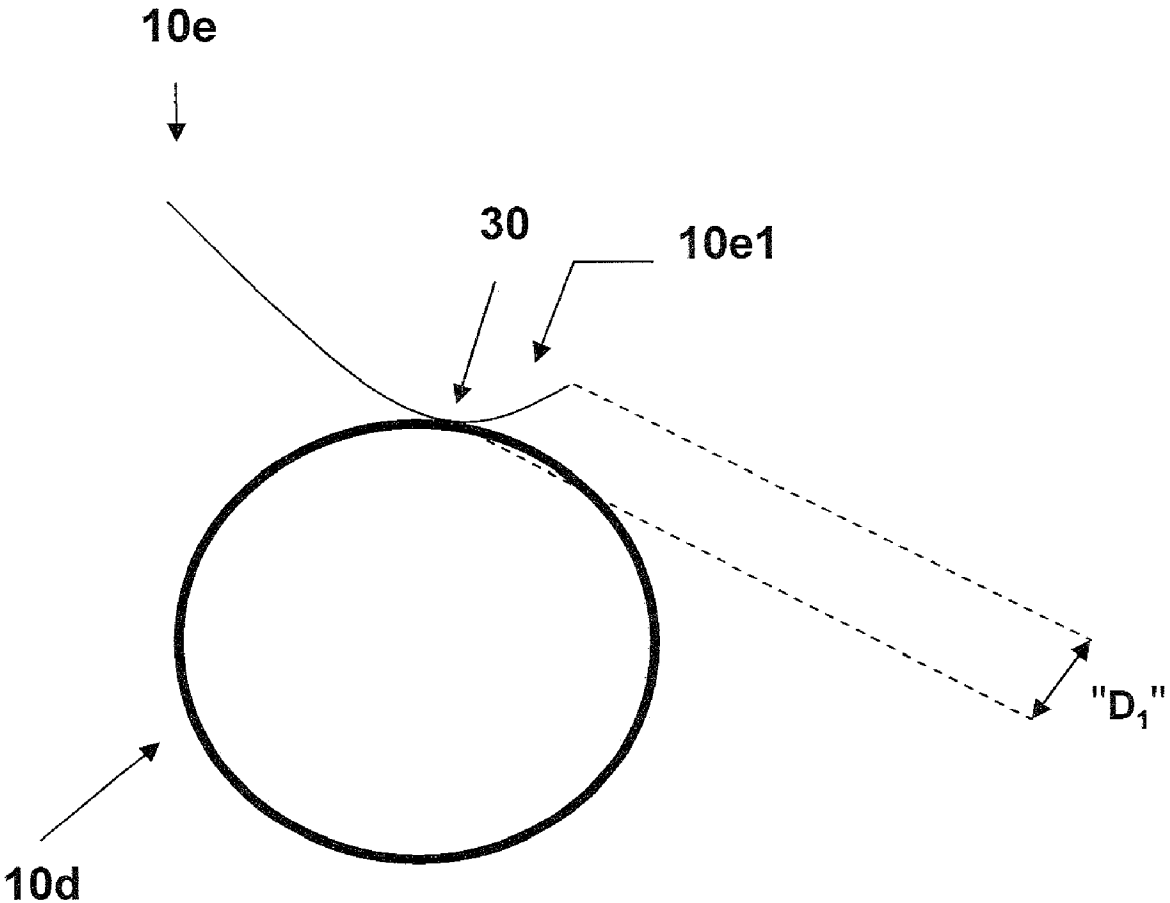
FIGS. 6*a*-6*c* are cross-sectional views of an exemplary blade and roller.
Figure 6B:
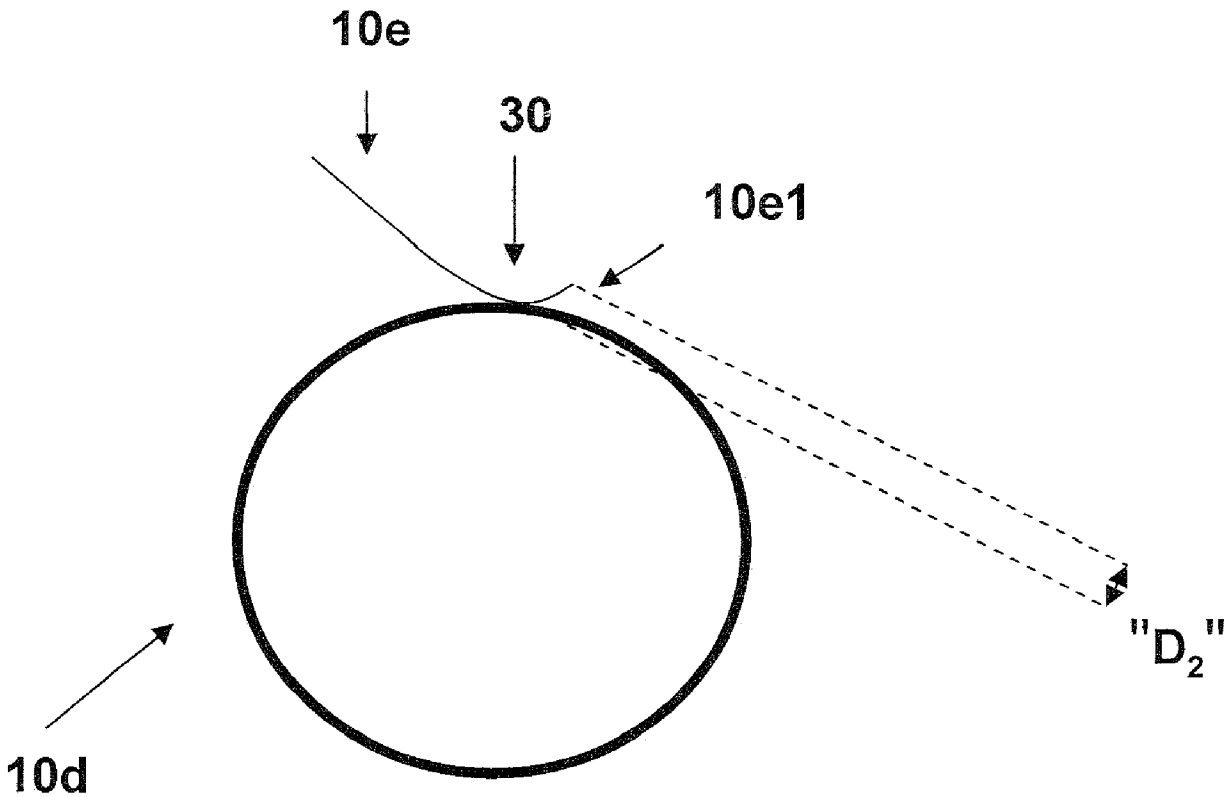
Figure 6C:
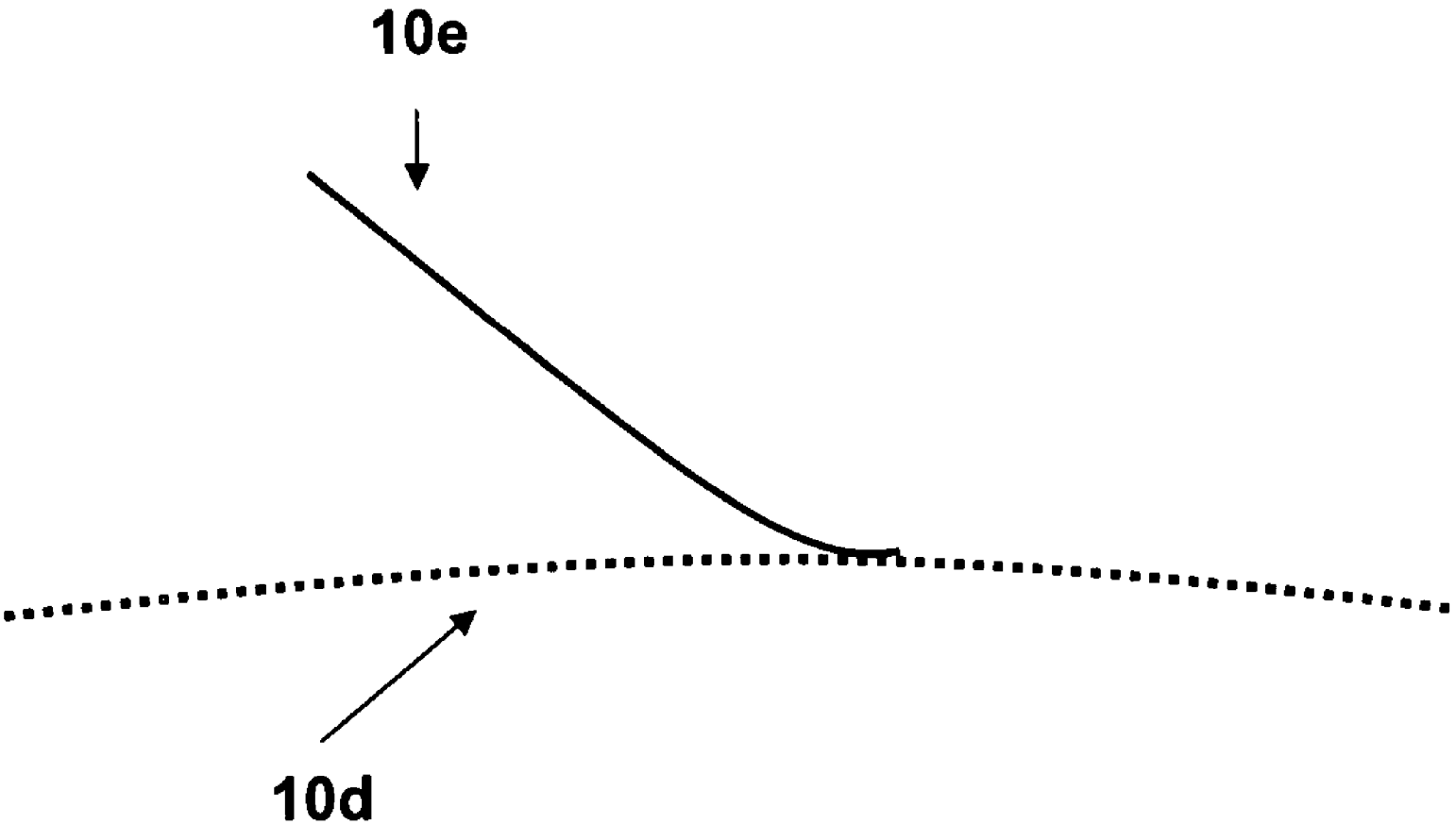

In addition, where a "checkmark" blade is employed with flange running along all or a portion of the blade edge, the flange may be an upstanding flange (10*e*1) relative to the roller. The flange may then be trimmed back to at or near the tangent point at the particular region wherein the blade may engage with the end seal. For example, with reference to FIG. 6*a*, the portion (10*e*1) may be trimmed back to at or near the tangent point location 30. This may be illustrated by FIG. 6*b* which shows portion 10*e*1 that is trimmed back more towards the tangent point location relative to what is shown in FIG. 6*a* to provide a sealing location. Furthermore, FIG. 6*c* provides another illustration where the portion 10*e*1 has been substantially trimmed back or removed which may also then provide a sealing location for the seal 24. It may therefore be the case that FIG. 6*c* illustrates an end portion of the blade where end seal 24 may seal as between the blade, roller and housing.

It can therefore be appreciated that the "checkmark" blade herein may include a portion (10*e*l) that runs along the length of the blade having a first extending dimension ($D_1$) beyond the contacting tangent point location 30 as shown in FIG.6*a*. Then, in the region where the blade may engage with the seal, the flange portion may be of a second dimension ($D_2$), which second extending dimension is less than that of the first extending dimension as shown in FIG. 6*b*. In addition, in the region where the blade engages with the seal, the flange may be completely removed back to the tangent point as shown in FIG. 6*c*. Furthermore, and optionally, in those cases where the flange may not be trimmed back to the tangent point at the region of engagement with the end seal (24), the end seal at each end of the blade may include a slit to receive such flange or be made of a material that may receive the flange and form a slit.

Figure 5:
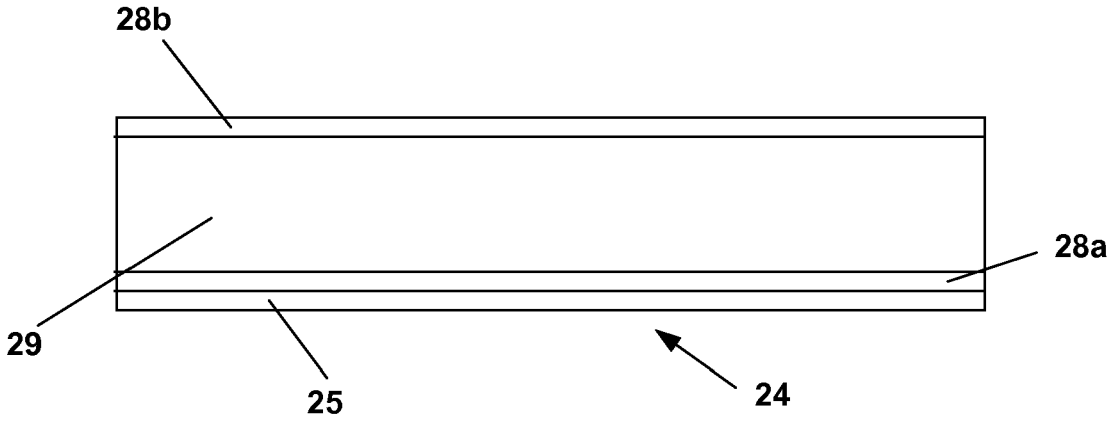
FIG. 5 is an enlarged side view of the exemplary end seal according to the present invention.

The end seals (24) of the present invention may comprise a relatively low modulus polymeric type material with a flex modulus of less than about 200,000 psi. The ends seals may include a relatively low density (about 4.0 to about 8.0 pounds per cubic foot) open-celled polyester urethane foam having a 25 percent Compression Load Deflection (CLD 25%) of about 0.6 (per ASTM D-3574-86). Other types of flexible foams such as polyether urethane, silicone or rubber may also be suitable. The end seals may also include or be composed of abrasion resistant material such as a non-woven material. An example of such non-woven material is a polyester ultra-microfiber non-woven with a non-fibrous polymeric binder such as a polyurethane binder. For example the non-woven material may be Ultrasuede® from Toray (Ultrasuede (America)), Inc., which may be adhered to the bottom surface of the end seals (24) to bear against the developer roller. This may be generally illustrated in FIG. 5 by reference numeral (25). As shown in FIG. 5, the exemplary seal (24) is presented in cross section, and may include a double-backed pressure sensitive adhesive tape (28*a*) to adhere the non-woven layer (25) to the foam (29). A second layer of tape (28*b*) may be used to adhere the foam (29) to the developer housing (12). In addition, the non-woven material for the seal (24) may have a basis weight of about 100-1000 g/m$^2$, a denier of about 0.01-0.2, a thickness of about 0.1-5.0 mm and a surface abrasion resistance (ASTM D3886 P800) of about 100-10,000, and values greater than 10,000, including all ranges and values between 100-10,000.

With reference to FIG. 5, it is also contemplated that the non-woven layer (25) may be adhered directly to the foam (29). For example, the foam layer itself may be one that during preparation thereof, affords a surface that may engage and adhere directly with the non-woven fibers. In addition, it is contemplated that the non-woven layer may be made to mechanically engage with the foam layer as a result of mechanical engagement of the non-woven fibers with, e.g., a course foam surface. In addition, it is contemplated that one may employ separate mechanical connectors.

For purposes of exemplification, various embodiments of the invention have been shown and described. However, it will be apparent that changes and modifications may be resorted to without departing from the spirit and scope of the invention.

What is claimed is:

1. An article used to seal in an image forming apparatus including a housing and a roller, comprising:

a blade having a length and contacting said roller at a contact location, wherein said blade is of a checkmark configuration including a first upstanding flange portion that extends from said contact location, and a second upstanding flange sealing portion;

wherein said first upstanding flange portion that extends from said contact location extends a first distance ($D_1$) along the length of said blade from said contact location and said second upstanding flange sealing portion comprises a second portion that engages with a sealing member and extends a second distance ($D_2$) from said contact location, where $D_2<D_1$;

wherein said sealing member is located between said blade and said housing.

2. The article of claim 1 wherein said contact location comprises a tangent point location.

3. The article of claim 1 wherein said sealing member comprises non-woven material.

4. The article of claim 3 wherein said non-woven material has denier of 0.01-0.2, a basis weight of greater than about 100 g/m$^2$ and an abrasion resistance of greater than 100 (ASTM D3886 P800).

5. The article of claim 1 wherein said roller comprises a developer roller in an electrophotographic device.

6. The article of claim 1 wherein said blade comprises a cantilevered doctor blade.

7. The article of claim 1 wherein said sealing member comprises a first layer of polymer material with a flex modulus of less than about 200,000 psi and a second layer of non-woven material.

8. An article used to seal in an image forming apparatus including a housing, a roller, a blade having a checkmark configuration and having an end location, a first seal portion positioned between said housing and said roller and a second seal portion extending along a length of said blade, said article comprising a sealing member positioned between said first seal portion and said second seal portion;

wherein said blade includes a first upstanding flange portion that extends from a contact location with said roller and a second upstanding flange sealing portion;

wherein said first upstanding flange portion that extends from said contact location extends a first distance ($D_1$) along the length of said blade from said contact location and said second upstanding flange sealing portion comprises a second portion that engages with a sealing member and extends a second distance ($D_2$) from said contact location, where $D_2<D_1$.

9. The article of claim 8 wherein said sealing member partially overlaps said end location of said blade.

10. The article of claim 8 wherein said first seal portion comprises a rotary seal portion which seals a space as between said roller and housing.

11. The article of claim 8 wherein said sealing member contacts said roller.

12. The article of claim 8 wherein said sealing member comprises a non-woven material.

13. The article of claim 12 wherein said non-woven material has denier of 0.01-0.2, a basis weight of greater than about 100 g/m$^2$ and an abrasion resistance of greater than 100 (ASTM D3886 P800).

14. The article of claim 8 wherein said roller comprises a developer roller in an eleoctrophotagraphic device.

15. The article of claim 8 wherein said blade comprises a cantilevered doctor blade.

16. The article of claim 8 wherein said sealing member comprises a first layer of polymer material with a flex modulus of less than about 200,000 psi and a second layer of non-woven material.

17. A sealing member for an image forming apparatus including a housing, a roller and a blade, comprising a sealing member positioned between said blade and said housing, said sealing member comprising a first layer of non-woven material and a second layer of material with a flex modulus of less than about 200,000 psi;

wherein said blade is of a checkmark configuration including a first upstanding flange portion that extends from a contact location and a second upstanding flange sealing portion;

wherein said first upstanding flange portion that extends from said contact location extends a first distance ($D_1$) along the length of said blade from said contact location and said second upstanding flange sealing portion comprises a second portion that engages with said sealing member and extends a second distance ($D_2$) from said contact location, where $D_2<D_1$.

18. The sealing member of claim 17 wherein said non-woven material has a basis weight of greater than about 100 g/m$^2$ and an abrasion resistance of greater than 100 (ASTM D3886 P800).

19. A cartridge detachably mounted to an image forming apparatus comprising:

a housing, a roller, a blade having a length wherein said blade is of a checkmark configuration, wherein said blade contacts said roller at a contact location;

said blade including a first upstanding flange portion that extends beyond said contact location, and a second upstanding flange sealing portion;

wherein said first upstanding flange portion that extends from said contact location extends a first distance ($D_1$) along the length of said blade from said contact location and said second upstanding flange sealing portion comprises a second portion that engages with a sealing member and extends a second distance ($D_2$) from said contact location, where $D_2<D_1$; and wherein said sealing member is located between said blade and said housing.

20. A cartridge detachably mounted to an image forming apparatus comprising a housing, a roller, a blade having an end, a first seal portion positioned between said housing and said roller and a second seal portion extending along a length of said blade, and a sealing member positioned between said first seal portion and said second seal portion;

wherein said blade is of a checkmark configuration including a first upstanding flange portion that extends from a contact location and a second upstanding flange sealing portion;

wherein said first upstanding flange portion that extends from said contact location extends a first distance ($D_1$) along the length of said blade from said contact location and said second upstanding flange sealing portion comprises a second portion that engages with said sealing member and extends a second distance ($D_2$) from said contact location, where $D_2<D_1$.

21. A cartridge detachable mounted to an image forming apparatus comprising a housing, a roller, a blade and a sealing member positioned between said blade and said housing, said sealing member comprising a layer of non-woven material and a layer of a material with a flex modulus of less than about 200,000 psi;

wherein said blade is of a checkmark configuration including a first upstanding flange portion that extends from a contact location and a second upstanding flange sealing portion;

wherein said first upstanding flange portion that extends from said contact location extends a first distance ($D_1$) along the length of said blade from said contact location and said second upstanding flange sealing portion comprises a second portion that engages with said sealing member and extends a second distance ($D_2$) from said contact location, where $D_2<D_1$.

* * * * *